US008382238B2

(12) United States Patent
Kanke et al.

(10) Patent No.: US 8,382,238 B2
(45) Date of Patent: Feb. 26, 2013

(54) INKJET RECORDING APPARATUS

(75) Inventors: Tsuyoshi Kanke, Yokohama (JP); Riichi Saito, Fujisawa (JP); Nobuyuki Kuwabara, Hachioji (JP); Osamu Sato, Takasaki (JP); Noribumi Koitabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 285 days.

(21) Appl. No.: 12/815,925

(22) Filed: Jun. 15, 2010

(65) Prior Publication Data

US 2010/0321425 A1 Dec. 23, 2010

(30) Foreign Application Priority Data

Jun. 23, 2009 (JP) ..... 2009-149064

(51) Int. Cl.
*B41J 2/165* (2006.01)

(52) U.S. Cl. ..... 347/33; 347/7

(58) Field of Classification Search ..... 347/7, 33
See application file for complete search history.

(56) References Cited

U.S. PATENT DOCUMENTS

| | | | | |
|---|---|---|---|---|
| 6,609,780 | B2 * | 8/2003 | Sugiyama | 347/33 |
| 7,604,327 | B2 * | 10/2009 | Sugahara | 347/7 |
| 2009/0051724 | A1 * | 2/2009 | Katoh | 347/18 |

FOREIGN PATENT DOCUMENTS

JP 03-99857 A 4/1991

* cited by examiner

*Primary Examiner* — Julian Huffman
(74) *Attorney, Agent, or Firm* — Canon USA, Inc., IP Division

(57) ABSTRACT

During a cleaning operation, the following steps are executed. The steps includes a first step of pressurizing ink in a supply path to overflow the ink from a nozzle, a second step of stopping the pressurization, a third step of executing wiping while the pressurization is stopped and a negative pressure is not applied, and a fourth step of applying a negative pressure to the ink at the nozzle to generate a meniscus.

7 Claims, 10 Drawing Sheets

INKJET RECORDING APPARATUS

BACKGROUND OF THE INVENTION

1. Field of the Invention

The present invention relates to a cleaning technique for an inkjet recording head.

2. Description of the Related Art

In a recording head including a nozzle face at which nozzles for discharging ink are provided, paper powder and dust floating in the air (hereinafter, referred to as dust) may adhere on the nozzle face. When such dust adheres, an accuracy of ink droplet impact positions is deteriorated, a condition in which ink droplets do not properly impacted may occur, and an undesired line may be generated in an image. To solve such a problem, a general printer includes a cleaning mechanism for wiping dust off a nozzle face with a wiper made of a flexible material.

Japanese Patent Application Laid-Open No. 3-99857 discusses an example of a printer including a cleaning mechanism. This device performs wiping while pressurizing ink to be supplied to the recording head and overflowing the ink from the nozzle during a cleaning operation. Thus, a wiping effect is improved by preventing dust being pushed into the nozzle by the wiper while wiping. The pressurization is stopped when the wiper moves to an end position, and the ink overflowed on the nozzle face is drawn into the nozzle by a negative pressure in the recording head. Then, a meniscus shape of the ink is formed due to a surface tension of the ink.

According to the device discussed in Japanese Patent Application Laid-Open No. 3-99857, since a large amount of ink is overflowed during wiping, a large amount of ink is gathered by wiping. Further, ink leaks from the nozzle immediately after the wiper passes through. Thus, the gathered ink may flow from both ends of the wiper and mix with the ink overflowed after the wiper is moved.

Accordingly, the dust included in the gathered ink may move back to the nozzle together with the ink. If the large amount of ink on the nozzle face is drawn into the nozzle by a negative pressure when the pressurization is stopped, the dust may be drawn into the nozzle with the ink, and may adhere on the discharge port again. This causes a cleaning failure (see FIG. 10).

Further, the device discussed in Japanese Patent Application Laid-Open No. 3-99857 keeps pressurizing until the wiping ends, there is a problem that a large amount of ink is consumed every time cleaning is executed.

SUMMARY OF THE INVENTION

The present invention is directed to an inkjet recording apparatus capable of effectively removing dust, which cannot be wiped away by a conventional wiping.

According to an aspect of the present invention, a recording apparatus includes a recording head including a nozzle face at which a nozzle for discharging ink is formed, a supply system including a supply path for supplying ink to the nozzle, a wiping mechanism configured to contact a wiper to the nozzle face, move the wiper and the nozzle face relatively, and execute cleaning of the nozzle face, and a control unit configured to control the supply system and the wiping mechanism, wherein the control unit controls the supply system and the wiping mechanism in a cleaning operation, at the following the steps of: a first step of pressurizing ink in the supply path and overflowing the ink from the nozzle; a second step of stopping the pressurization after the first step; a third step of executing wiping, after the second step, in a condition in which the pressurization is stopped and a negative pressure is not applied to the ink at the nozzle; and a fourth step, after the third step, of applying a negative pressure to the ink at the nozzle and generating a meniscus.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Note that the components described in the exemplary embodiments are just examples and the range of the present invention should not be limited to the examples. Hereinafter, an exemplary embodiment of an inkjet type printer will be described as an example of a recording apparatus. In this specification, the "recording apparatus" is not limited to an apparatus dedicated to a printing function, and includes a multifunction peripheral that includes a printing function and other functions therein, a production device for forming a pattern on a substrate, and the like.

Figure 1:
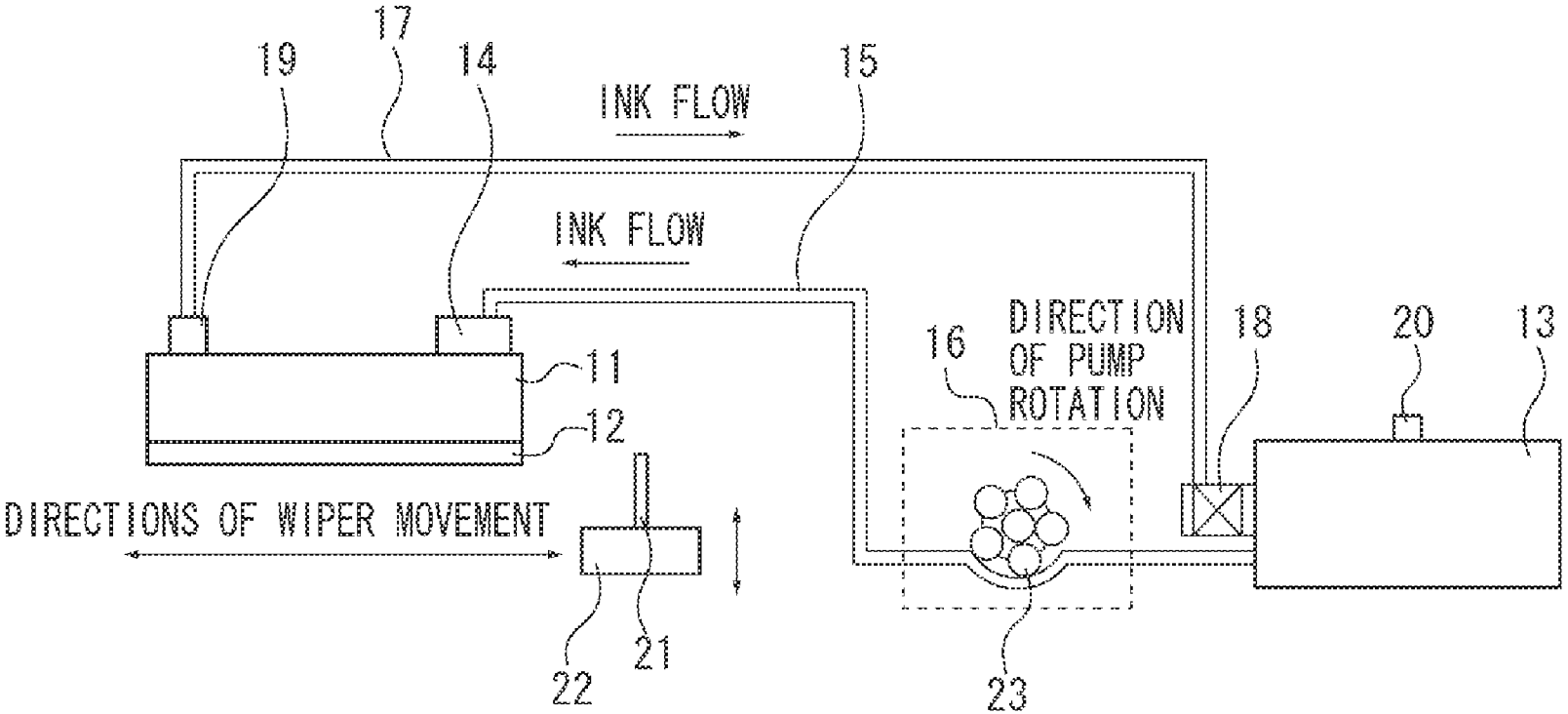
FIG. 1 illustrates a main part of a recording apparatus.

FIG. 1 illustrates a configuration of a main part of the inkjet printer of the present exemplary embodiment. A recording apparatus 1 includes a recording head 12 for discharging ink from nozzles and performing printing on a medium. An ink supply system supplies ink from an ink tank 13 and returns the ink, which is not discharged to the recording head 12, to the ink tank 13. The ink supply system includes the ink tank 13 for storing ink, a supply tube 15 (supply path) for supplying ink from the ink tank 13 to the recording head 12, and a recovery tube 17 (recovery path) for recovering ink from the recording head 12 to the ink tank 13.

The supply tube 15 is made of a flexible material and can be deformed by pressure as described below. A pressure pump 16 for supplying ink from the ink tank 13 to the recording head 12 is provided at a part of the path of the supply tube 15. An opening/closing valve 18 for opening and closing the path is provided at the recovery path.

The recording head 12 includes six line heads corresponding to six color inks, for example. The number of colors is not limited to six, and may be one or a number other than six. The line heads of the respective colors may be a single seamless nozzle tip or divided nozzle tips, which are arranged in a line or a staggered pattern. In purpose of simplification of explanation, a supply system of only one color will be described in the present exemplary embodiment, however, the similar supply system is provided for each color ink in an actual apparatus.

A wiping mechanism includes a wiper 21 and a wiper holder 22. In the wiping mechanism, the wiper 21 is made contact with a nozzle face of the recording head 12, and the positional relation between the wiper 21 and the recording head 12 is changed in a direction relatively parallel to the nozzle face to perform a nozzle face cleaning operation.

The wiper 21 is held by the wiper holder 22. The wiper holder 22 can move in a direction parallel to the nozzle face (in a longitudinal direction of the nozzle face on which a plurality of nozzles are arranged) at least in the length of the nozzles arranged in the longitudinal direction. Further, the wiper holder 22 moves in a direction intersecting the nozzle face to shift between a position where an end of the mounted wiper 21 contacts with the nozzle face and a position where the end of the wiper 21 is away from the nozzle face.

Members in the supply system will be described in more detail. The recording head 12 includes a supply port 14, to which the supply tube 15 is connected, and a recovery port 19, to which the recovery tube 17 is connected. Inside the recording head 12, there is a liquid chamber for storing a predetermined amount of ink as described below. The supply tube 15 and recovery tube 17 are connected to the ink tank 13 for storing ink, and an air communication port 20 is provided at a top face of the ink tank 13.

There is a difference in height between a bottom face of the ink tank 13 and the nozzle face of the recording head 12. For example, there is a head difference of 150 mm. Such a head difference generates a balanced state of a negative pressure at the recording head 12 and a meniscus force at the nozzle, and this prevents a leakage of ink from the nozzle and an excessive ink flow from the nozzle during recording.

Figure 2A:
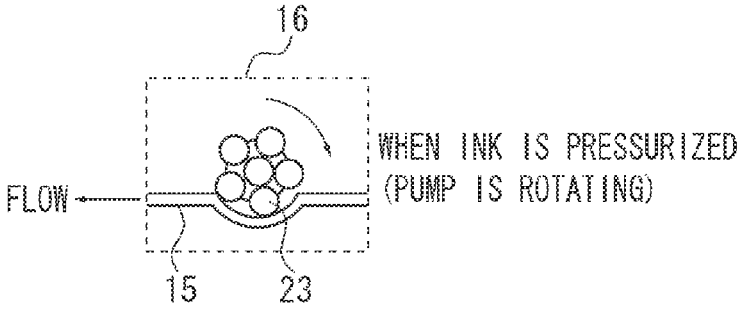
FIGS. 2A, 2B, and 2C illustrate an operation of a pressure pump.
Figure 2B:
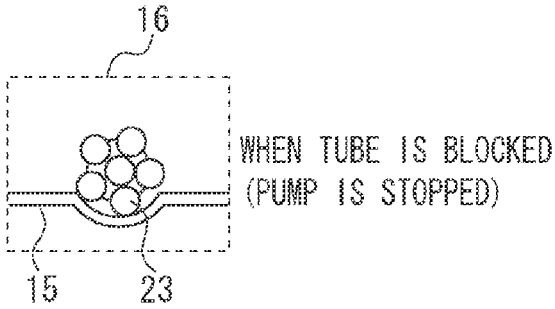
Figure 2C:
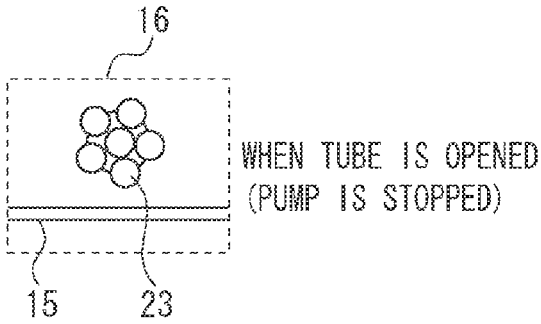

The pressure pump 16 is a so-called tube pump, in which a pressure roller 23 rotates to pressurize the supply tube 15 to pressurize inside the supply tube 15. FIGS. 2A to 2C are diagrams illustrating an operation of the pressure pump 16. FIG. 2A illustrates a state in which the pressure pump 16 operates to pressurize the supply tube 15. The pressure roller 23 has a configuration in which plural rollers are concentrically arranged in a circumferential direction.

One or more of the rollers of the pressure roller 23 contact with the supply tube 15, and press to concave the flexible tube. Then, when the pressure roller 23 rotates in a clockwise direction as illustrated in the FIG. 2A to 2C, and changes its position to the tube, the portion to be pressed and concaved by the roller is sequentially shifted, and released portions return to the original shape.

The one or more rollers squeeze the supply tube 15, and press the ink in the tube in the direction indicated by the arrow to generate an ink flow. In this manner, pressure is applied to the supply tube 15 between the pressure pump 16 and recording head 12.

FIGS. 2B and 2C illustrate states in which the pressure pump 16 is being stopped. In the state of FIG. 2B, since one or more rollers of the pressure roller 23 contact with and press to concave the supply tube 15, the flow path of the supply tube 15 is blocked. On the other hand, in the state of FIG. 2C, since the pressure roller 23 is away from the supply tube 15 and the supply tube 15 is not being pressed, the flow path of the supply tube 15 is being opened.

More specifically, the pressure roller 23 functions not only as a pressure pump but also as an opening/closing valve of the flow path. The pressure roller 23 can switch between the closed valve state (FIG. 2B) and the opened valve state (FIG. 2C). Here, in the present exemplary embodiment, the pressure pump 16 is described as a tube pump, however, the pressure pump 16 is not limited to this, and may be provided as another type of pump such as a piston pump.

Figure 3A:
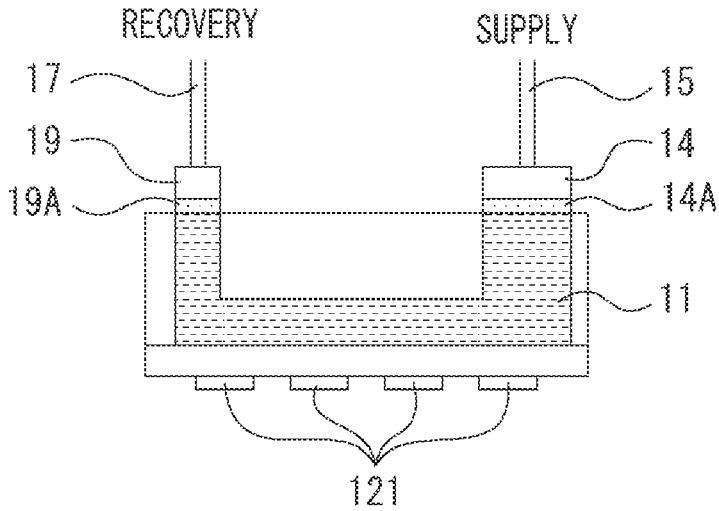
FIGS. 3A and 3B are sectional views illustrating a configuration of a recording head.

FIG. 3A is a sectional view illustrating a configuration of the recording head 12. The recording head 12 includes a liquid chamber 11, a nozzle tip 121, the supply port 14, a filter 14A, the recovery port 19, and a filter 19A. The liquid chamber 11 temporarily stores ink and supplies the ink to the nozzle tip 121. An end of the liquid chamber 11 is connected to the supply port 14, and another end is connected to the recovery port 19. The supply tube 15 is connected to the supply port 14.

The filter 14A is provided inside the supply port 14, and ink supplied from the supply tube 15 is introduced in to the liquid chamber 11 after dust included therein is filtered by the filter 14A. The recovery tube 17 is connected to the recovery port 19. The filter 19A is provided inside the recovery port 19, and ink in the liquid chamber 11 is discharged from the recovery tube 17 after filtered by the filter 19A.

Figure 3B:
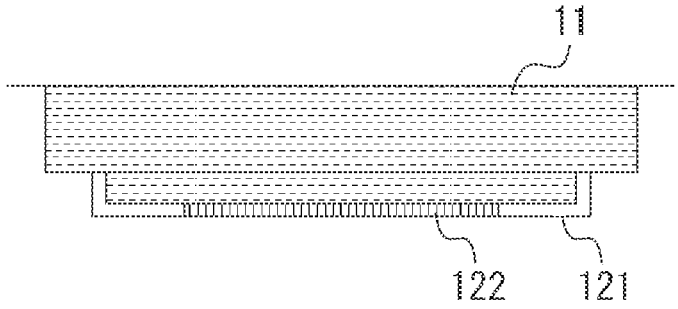

FIG. 3B is a sectional view of the nozzle tip 121. At the nozzle face, there are plural nozzles 122 for discharging the ink, as ink droplets, supplied from the liquid chamber 11. As described above, the wiper 21 moves in a direction along the alignment of the nozzles 122 when wiping is performed.

An energy generating element for discharging ink droplets is provided at the respective nozzles 122. In the present exemplary embodiment, the energy generating element is a heat generating element. In addition to this, other types of inkjet methods can be used, such as a method using a piezo element, a method using an electrostatic element, and a method using a microelectromechanical system (MEMS) element.

Figure 4:
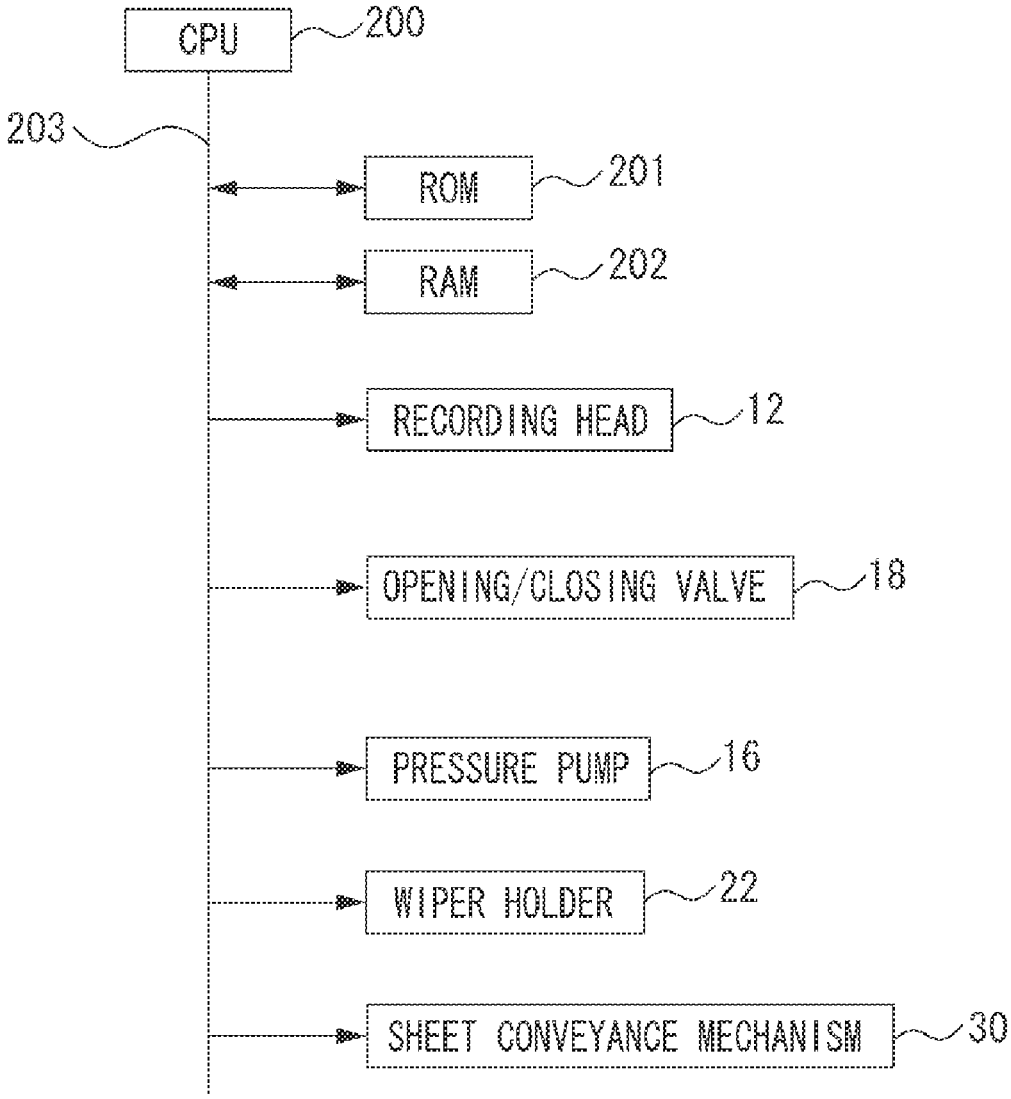
FIG. 4 is a block diagram of a control system.

FIG. 4 is a block diagram illustrating a control system of the recording apparatus. A central processing unit (CPU) 200 performs various controls of the overall recording apparatus. A read-only memory (ROM) 201 stores a control program or control data. A random access memory (RAM) 202 serves as a data storage area developed for image processing, or temporarily stores control parameters.

A bus 203 transmits data or a control command. The CPU 200, ROM 201, RAM 202, and bus 203 mainly constitute a controller. A control command from the CPU 200 is transmitted to the pressure pump 16, opening/closing valve 18, recording head 12, wiper holder 22, sheet conveyance mechanism 30, and the like via the bus 203, and the respective components operate according to the command. The sheet conveyance mechanism 30 is a mechanism including a conveyance roller and the like to convey a sheet, on which printing is performed by the recording head 12, at a constant speed.

The ROM 201 of the controller stores a control program for selectively executing operations in a printing mode and a cleaning mode. In the printing mode, the controller controls to discharge ink from the recording head 12 to form an image on a sheet while conveying the sheet to the recording head 12 by the sheet conveyance mechanism 30.

Figure 5:
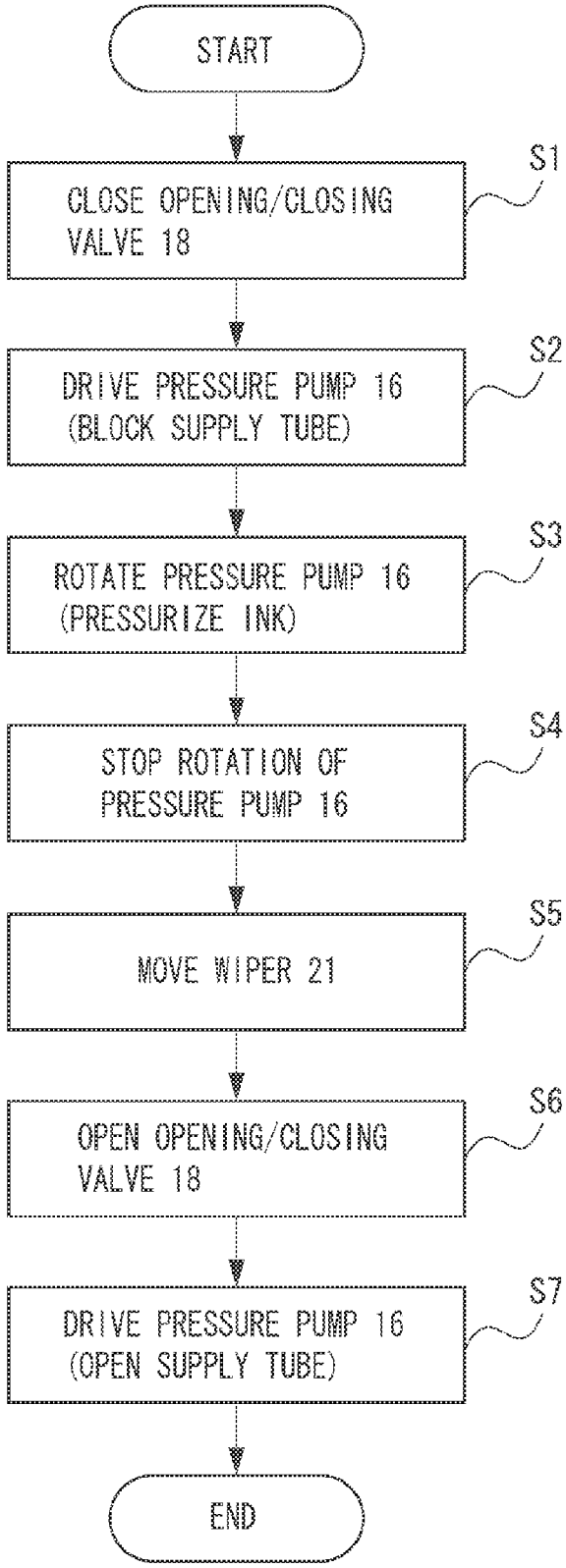
FIG. 5 is a flow chart illustrating an operation sequence.

A sequence of a cleaning operation when the cleaning mode is selected will be described. FIG. 5 is a flowchart of an operation sequence and FIGS. 6A to 6H illustrates the states in respective steps of the cleaning operation.

Figure 6A:
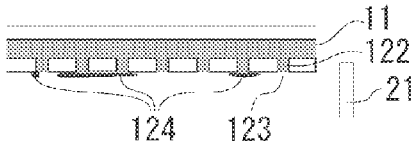
FIGS. 6A to 6H illustrate a cleaning operation.

In an initial state when an operation in the cleaning mode starts, there is dust 124 adhered at the discharge ports 123 or the nozzle face of the recording head 12 as illustrated in FIG. 6A, for example. When there is some ink between the nozzle face and the dust 124, the dust 124 is strongly adhered to the nozzle face due to an interfacial tension of the ink. Further, since the ink at the nozzle is kept in a negative pressure due to the difference of hydraulic head pressures generated by the difference of the height between the ink tank 13 and the nozzle face of the recording head 12, a meniscus shape is formed.

Here, in step S1 of FIG. 5, the opening/closing valve 18 is closes, and the recovery tube 17 is blocked. In step S2, the pressure pump 16 is started to operate. The pressure roller 23 becomes in the state of FIG. 2B, and the supply tube 15 is blocked. The order of steps S1 and S2 can be switched, or those operations can be executed at the same time.

Figure 6B:
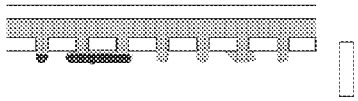
Figure 6C:
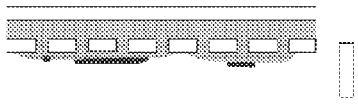
Figure 6D:
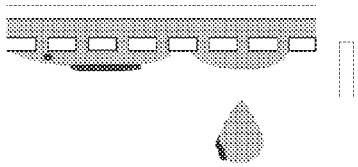

In step S3, the pressure pump 16 starts to apply pressure to ink. The pressure roller 23 starts to rotate as illustrated in FIG. 2A. As illustrated in FIG. 6B, the ink is pressed out from the respective nozzles 122 of the recording head 12, and the ink overflows on the nozzle face. Then, the dust 124 adhered on the nozzle face is drawn out with the overflowing ink, removed from the nozzle face, and stays in the flown ink or on the surface of the ink at a boundary with the air. When the pressure is kept being applied, inks separately overflowed from the respective nozzles meet and mix with one another so that a large ink droplet is formed between the plural nozzles, as illustrated in FIG. 6C. When pressure is further applied, a part of the ink droplet drips due to gravity, as illustrated in FIG. 6D. In this case, a part of the dust falls together with the ink and removed from the nozzle face.

Figure 6E:
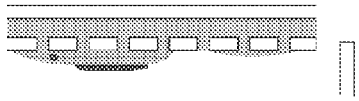

In step S4, the rotation of the pressure pump 16 is stopped to stop pressurizing. The pressure roller 23 becomes in the state illustrated in FIG. 2B, and blocks the supply tube 15. The opening/closing valve 18 is also closed. Since the valves in both of the supply and recovery paths are closed, there is no difference between the hydraulic head pressures generated by the difference in heights of the ink tank 13 and the nozzle face of the recording head 12. Thus, a negative pressure is not generated at the recording head 12, and the nozzle face maintains the overflowed ink as illustrated in FIG. 6E.

In step S5, the wiper 21 is moved by the wiper holder 22 to perform a wiping operation on the nozzle face of the recording head 12. Since the dust 124 exists in the overflowed ink or on the surface of the ink at a boundary with the air, the dust 124 can be easily wiped off together with the overflowed ink.

Figure 6F:
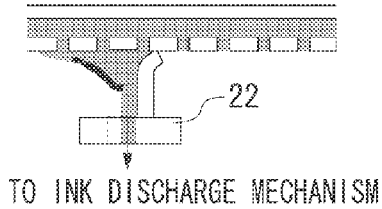
Figure 6G:
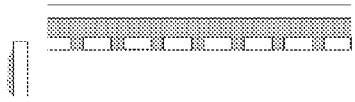

As illustrated in FIG. 6F, the wiped ink and dust are gathered in a moving direction of the wiper 21, and discharged to an ink discharge mechanism via the wiper holder 22. FIG. 6G illustrates a state in which the wiper 21 is in a wiping end position. All the dust adhered on the nozzle face is removed.

After that, in step S6, the opening/closing valve 18 is switched from a closed state to an opened state. Then, in step S7, the pressure roller 23 of the pressure pump 16 is separated away from the supply tube 15, and becomes in a state illustrated in FIG. 2C. The order of operations in steps S6 and S7 can be switched, or those operations can be executed at the same time.

Figure 6H:
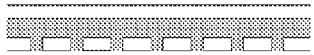

In addition, only one of the pressure pump 16 and the opening/closing valve 18 may be opened. In this manner, since at least one of (preferably, both of) the valves of the supply path and recovery path is released, a negative pressure is applied to the nozzles of the recording head 12 and a negative meniscus is generated due to a surface tension of the ink as illustrated in FIG. 6H. As described above, the sequence of the cleaning operation ends.

One of characteristics of the present exemplary embodiment is that pressurization is stopped and a negative pressure is not applied to the ink at the nozzles during a wiping operation since pressurization stops before the wiping operation in step S4. With this configuration, ink does not overflow from the nozzles immediately after the wiper 21 passes therethrough. This solves the above problem described referring to FIG. 10. Further, in the present exemplary embodiment, since a large amount of ink will not overflow from the nozzles during wiping, the amount of ink consumed in a cleaning operation can be reduced.

Further, another characteristic of the present exemplary embodiment is that a part of ink droplet drips due to gravity before wiping, and a part of dust also falls with the ink as illustrated in FIG. 6D. Since a part of the dust is removed before wiping, cleaning can be surely performed.

Figure 7A:
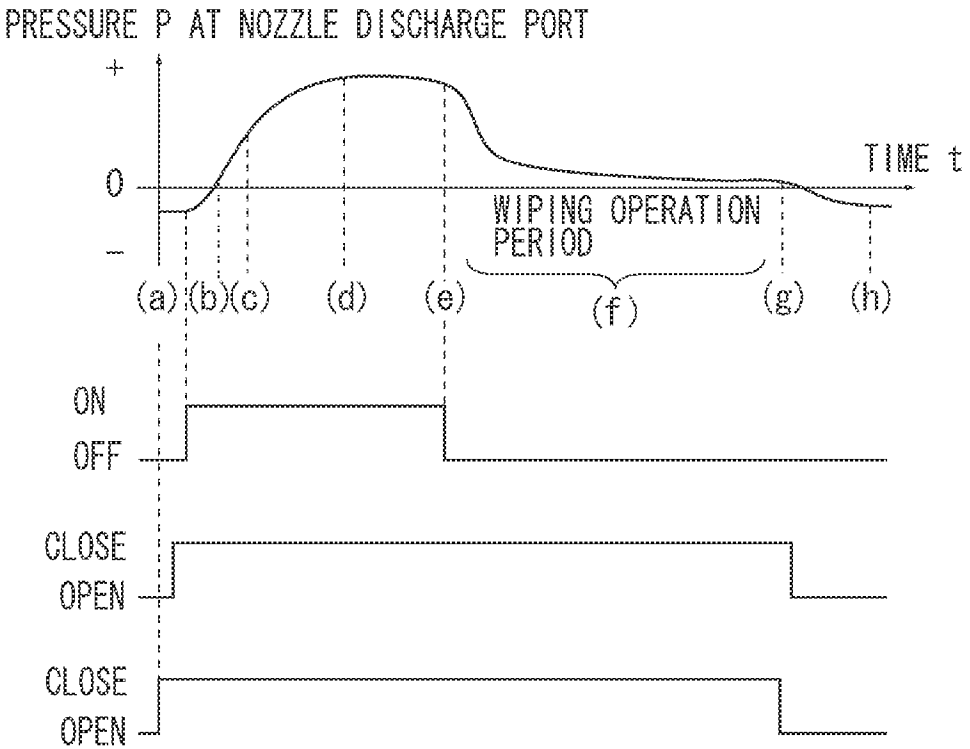
FIGS. 7A and 7B illustrate a pressure change at a nozzle during the cleaning operation.
Figure 7B:
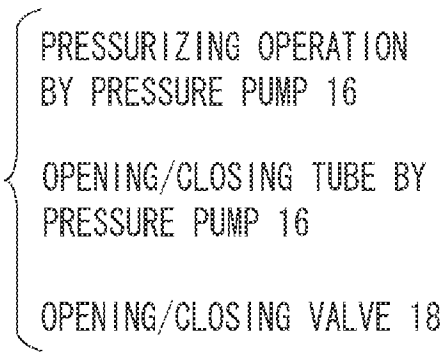

FIGS. 7A and 7B illustrate a time-series pressure change at the nozzles during the cleaning operation. The graph of FIG. 7A illustrates pressure P applied to ink at the discharge ports of the nozzles. The horizontal axis indicates time and the references (a) to (h) correspond to the states of FIGS. 6A to 6H, respectively.

FIG. 7B illustrates respective timings of the ON/OFF of the pressurizing operation by the pressure pump 16, the opening/closing state of the supply tube 15 by the pressure pump 16, and the opening/closing of the opening/closing valve 18 in recovery side.

As illustrated in FIG. 7A, at time (e), even when pressurization of the pressure pump 16 is turned off, the pressure P at the nozzles does not immediately change from positive pressure to zero. The pressure P at the nozzles reduces rapidly at the first stage and reduces slowly after that. The pressure P becomes close to zero but will not be zero or below during a wiping period.

This is because the both of the valves in the supply side and recovery side are closed. In this case, even though the pressure P is a positive pressure, the pressure pump 16 is not performing pressuring operation, so that a positive meniscus is formed due to the surface tension of the ink at the discharge ports of the nozzles immediately after the wiper passes therethrough and the ink will not overflow from the discharge ports.

At a time (g) after wiping ends, since at least one of the valves in the supply side and the recovery side is opened, the pressure P finally becomes blow zero and a negative meniscus is formed at the discharge ports of the nozzles due to the negative pressure. When a meniscus is formed, dust will not drawn into the discharge ports together with ink since the amount of ink drawn into the discharge ports is not large, differently from the conventional example of FIG. 10.

As a second exemplary embodiment, a method capable of performing a cleaning operation of the recording head with a small amount of waste ink will be described. FIGS. 8A to 8E illustrates a sequence of a cleaning operation of the second exemplary embodiment.

Figure 8A:
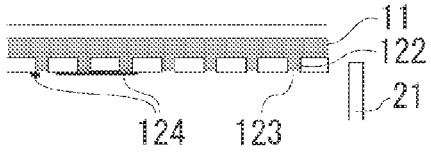
FIGS. 8A to 8E illustrate a cleaning operation of a second exemplary embodiment.
Figure 8B:
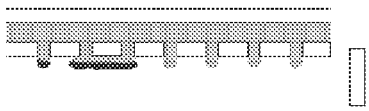

FIGS. 8A and 8B are similar to FIGS. 6A and 6B of the first exemplary embodiment. In the present exemplary embodiment, before ink that is pressed out from the nozzles drips, the pressurization by the pressure pump 16 is stopped when the ink is slightly overflowed from the nozzles by the pressure as illustrated in FIG. 8B. In this case, since the opening/closing valve 18 is being closed and the pressure roller 23 blocks the supply tube 15, a negative pressured is not generated at the recording head 12, and the overflowed ink is kept on the nozzle face.

Figure 8C:
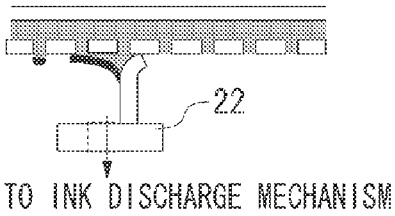
Figure 8D:
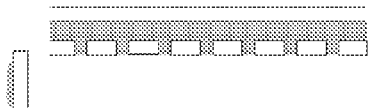
Figure 8E:
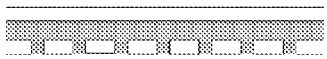

Next, as illustrated in FIG. 8C, a wiping operation is executed by moving the wiper 21. Since the amount of the ink overflowed on the nozzle face is smaller than that in the first exemplary embodiment, the amount of waste ink discharged to the ink discharge mechanism via the wiper holder 22 in the wiping operation is reduced. FIGS. 8D and 8E are the same as FIGS. 6G and 6H.

Figures 9A, 9B:
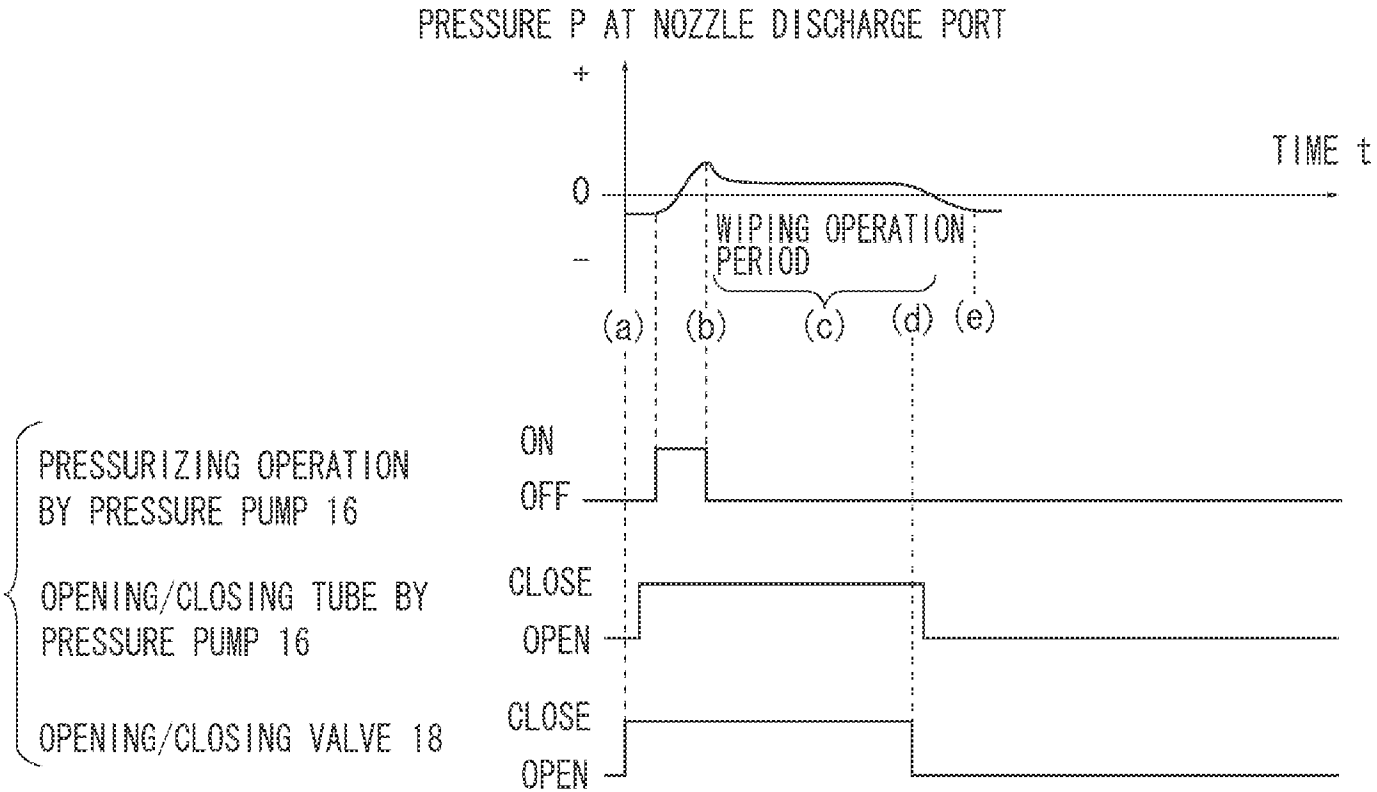
FIGS. 9A and 9B illustrate a pressure change at a nozzle during the cleaning operation.
Figure 10A:
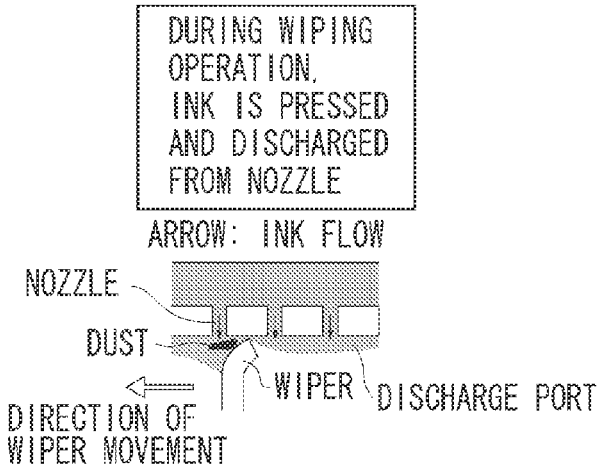
FIGS. 10A to 10D illustrate a conventional cleaning operation.
Figure 10B:
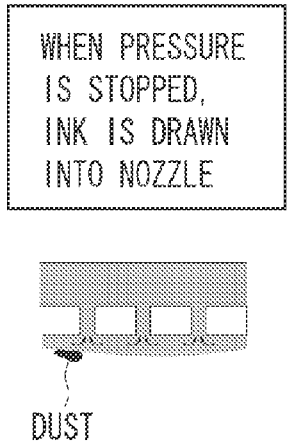
Figure 10C:
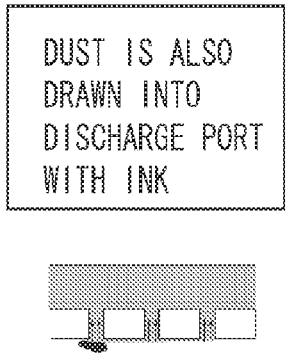
Figure 10D:
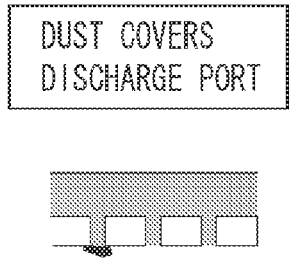

FIGS. 9A and 9B illustrates a time-series pressure change at the nozzles during a cleaning operation. Since the period of pressurization by the pressure pump 16 is short, it is clear that the overall time is shortened, compared to the overall time of the example in FIGS. 7A and 7B.

The present exemplary embodiment omits the processes of FIGS. 6C to 6E of the first exemplary embodiment. With this configuration, compared to the first exemplary embodiment, the amount of waste ink can be reduced and a cleaning operation can be executed in a shorter period of time.

According to the exemplary embodiments of the present invention, dust that cannot be sufficiently wiped off by a conventional wiping method can be effectively removed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-149064 filed Jun. 23, 2009, which is hereby incorporated by reference herein in its entirety.

What is claimed is:

1. A recording apparatus comprising:

a recording head including a nozzle face at which a nozzle for discharging ink is formed;

an ink tank configured to store ink to be supplied to the recording head;

a supply path configured to supply ink from the ink tank to the recording head;

a pump provided at a part of the supply path and configured to supply ink from the ink tank to the recording head;

a wiping mechanism configured to contact a wiper to the nozzle face, move the wiper and the nozzle face relatively, and execute cleaning of the nozzle face; and a control unit configured to control the pump and the wiping mechanism, wherein the control unit controls the pump and the wiping mechanism in a cleaning operation, so that the following steps are executed, the steps including:

a first step of driving the pump to supply ink from the ink tank to the recording head and overflowing ink from the nozzle;

a second step of stopping the driving of the pump and blocking the supply path with the pump after the first step;

a third step of executing wiping, after the second step, in a condition in which the supply path is blocked by the pump; and a fourth step, after the third step, of stopping the blocking of the supplying path.

2. A recording apparatus according to claim 1, further comprising a recovery path configured to recover ink from the recording head to the ink tank.

3. A recording apparatus according to claim 2, wherein the control unit controls the supply path and the recovery path to be closed from the first step to the third step, and to be opened at least in one of the supply path and the recovery path in the fourth step, and wherein the control unit controls the pump to execute pressurization in the first step, and stop pressurization from the second step to the fourth step.

4. A recording apparatus according to claim 3, wherein the pump is a tube pump.

5. A recording apparatus according to claim 4, wherein the tube pump includes a roller and functions as a pressure pump for pressing out ink by moving the roller while the roller is contacted with a flexible tube that constitutes the supply path, and an opening/closing valve for switching a contact state and a separated state of the roller to the tube.

6. A recording apparatus according to claim 2, wherein the recording head includes a nozzle tip including the nozzle face at which a plurality of nozzles are provided, a liquid chamber configured to store ink to be supplied to the nozzle, a supply port connected to the supply path and an end of the liquid chamber, and a recovery port connected to the recovery path and another end of the liquid chamber different from the end in which the supply port is connected.

7. A recording apparatus according to claim 6, wherein the supply port and the recovery port each include a filter to filter ink.

* * * * *